US005571007A

United States Patent [19]

Ishiguro et al.

[11] Patent Number: 5,571,007

[45] Date of Patent: Nov. 5, 1996

[54] SYSTEM FOR MONITORING A COMBUSTION APPARATUS

[75] Inventors: Tomohisa Ishiguro; Atsushi Nishimura, both of Nagoya; Shigekazu Asai, Gifu, all of Japan

[73] Assignee: Paloma Kogyo Kabushiki Kaisha, Nagoya, Japan

[21] Appl. No.: 195,276

[22] Filed: Feb. 14, 1994

Related U.S. Application Data

[63] Continuation-in-part of Ser. No. 759,406, Sep. 13, 1991, abandoned.

[30] Foreign Application Priority Data

Feb. 1, 1991 [JP] Japan ..... 3-033572

[51] Int. Cl.[6] ..... F24H 9/00

[52] U.S. Cl. ..... 431/13; 431/18; 126/351; 377/15

[58] Field of Search ..... 431/16, 13, 18; 377/6, 15, 8, 38; 126/350 R, 351

[56] References Cited

U.S. PATENT DOCUMENTS

| | | | |
|---|---|---|---|
| 3,793,512 | 2/1974 | Lorenzen | 377/15 X |
| 3,916,123 | 10/1975 | Werner et al. | 377/15 |
| 4,330,261 | 9/1979 | Sun | 431/14 |
| 4,518,345 | 2/1983 | Mueller et al. | 431/24 |
| 4,525,782 | 6/1985 | Wohlfarth et al. . | |
| 4,525,783 | 6/1985 | Pischke et al. . | |
| 4,551,703 | 11/1985 | Bourauel et al. . | |
| 4,630,292 | 12/1986 | Juricich et al. | 377/15 X |
| 4,872,828 | 10/1989 | Mierzwinski et al. | 431/16 |
| 4,885,573 | 12/1989 | Fry et al. | 340/519 |
| 5,029,188 | 7/1991 | Lexa | 377/15 X |
| 5,231,594 | 7/1993 | Knibiehler et al. | 377/15 X |

FOREIGN PATENT DOCUMENTS

| | | |
|---|---|---|
| 59-145428 | 8/1984 | Japan . |
| 2-4128 | 1/1990 | Japan . |
| 2-33520 | 2/1990 | Japan . |
| 3-033572 | 11/1991 | Japan . |

*Primary Examiner*—Carl D. Price
*Attorney, Agent, or Firm*—Lahive & Cockfield

[57] ABSTRACT

The present invention provides a novel system for monitoring a predetermined operating condition of a heating apparatus, such as a cumulative total time period of combustion and a combustion frequency, and informing a user of a timing of maintenance. In a hot water heater (1) according to the invention, a controller (208) outputs a maintenance requirement signal to a display (210) and a maintenance alarm to inform the user of a timing of maintenance when a combustion frequency nx becomes equal to or greater than a first reference value nr1 or when a cumulative total time period of combustion tx becomes equal to or greater than a second reference value tr1. This allows the user to perform maintenance without delay and prevents troubles or abnormalities from being developed in the hot water heater (1).

10 Claims, 7 Drawing Sheets

SYSTEM FOR MONITORING A COMBUSTION APPARATUS

CROSS-REFERENCE TO RELATED APPLICATIONS

This is a continuation-in-part of U.S. patent application Ser. No. 07/759,406, now abandoned.

BACKGROUND OF THE INVENTION

1. Field of the Invention

The present invention relates to a system for monitoring predetermined operating conditions of a heating apparatus, such as a cumulative total time period of combustion and a combustion frequency, and informing a user of a timing of maintenance.

2. Description of the Related Art

Conventionally proposed devices as disclosed in JAPANESE PATENT LAYING-OPEN GAZETTE Nos. 2-4128 and 2-33520 monitor a heating apparatus to detect troubles and failures developed therein, and store and display types of such troubles and frequency of occurrence. All such devices monitor the heating apparatus only for taking countermeasures against the troubles which have already been developed, and are not capable of preventing such troubles to improve the durability or operating conditions of the heating apparatus.

There are only a few monitor systems proposed for monitoring a heating apparatus to detect operating conditions thereof. FIG. 6 schematically shows a structure of such a conventional monitor system incorporated in a hot water heater 10. When a user opens a faucet 101, cold water starts running through a cold water supply pipe 102 to turn a water flow switch 103 on. The turn-on operation of the water flow switch 103 opens both a main solenoid valve 104 and a primary solenoid valve 105 for receiving gas through a gas conduit 113 and activates an igniter 106 leading to discharge from an ignition electrode 107 for ignition. A burner controller 108 then compares a temperature detected by a water temperature sensor 109 attached to a hot water supply pipe 110 with a fixed temperature previously set in a remote control 111, and adjusts an opening of a proportional solenoid valve 112 based on the difference between the temperature measured and the fixed temperature. The opening of the proportional solenoid valve 112 here represents an amount of combustion. Through this feed-back control for adjusting the amount of combustion according to the deviation of the temperature, the temperature of hot water running from the faucet 101 is set approximately equal to the fixed temperature. When the user closes the faucet 101, the water flow switch 103 is turned off to close the main solenoid valve 104 and the primary solenoid valve 105 to stop supplying hot water.

The hot water heater 10 is further provided with a conventional heat exchanger 114, a flame rod 115 for detecting flame, a fan (not shown) for supplying the air to a burner, and a bimetal thermostat (not shown) for detecting overheat.

The monitor system of the hot water heater 10 shown in FIG. 6 has a timer 150 and a counter 151, both of which are externally connected to the main solenoid valve 104 for controlling combustion of the hot water heater 10. The timer 150 measures a time period when power is supplied to the main solenoid valve 104 while the counter 151 counts a frequency of power supply to the main solenoid valve 104.

Such a conventional monitor system requires separate measuring devices such as the timer 150 and the counter 151, which increases the manufacturing cost and makes the hot water heater undesirably bulky.

SUMMARY OF THE INVENTION

One object of the invention is accordingly to provide a novel monitor system which effectively monitors predetermined operating conditions of a heating apparatus without any separate measuring device.

Another object of the invention is to detect a cumulative total time period of combustion and a combustion frequency for preventing troubles from being developed in a heating apparatus.

These and the other objects are realized by a monitor system of the invention for monitoring operation of a heating apparatus to inform an operator of a timing of maintenance. The system of the invention includes: a monitor unit for continuously monitoring a predetermined operating condition of the heating apparatus; a first memory unit for storing a first reference value; a second memory unit for storing and continually updating the predetermined operating condition continuously monitored by the monitor unit; a first switch for outputting a display signal requiring display of the predetermined operating condition; a control unit for receiving the display signal output from the first switch and outputting a first control signal in response to the display signal, comparing the predetermined operating condition stored in the second memory unit with the first reference value stored in the first memory unit and outputting a second control signal when the predetermined operating condition becomes equal to or greater than the first reference value; and a display unit for receiving the first control signal output from the control unit to display the predetermined operating condition stored in the second memory unit, and receiving the second control signal output from the control unit to display a message for informing the operator of a timing of maintenance.

The system of the invention preferably includes a second switch for resetting the second memory unit to initialize the predetermined operating condition stored and continually updated in the second memory unit.

The first memory unit may also store a second reference value, and the system of the invention may further include a forcible operation-stop unit for forcibly stopping operation of the heating apparatus when the predetermined operating condition stored in the second memory unit becomes equal to or greater than the second reference value stored in the first memory unit.

In one preferable application of the system, the monitor unit detects a cumulative total time period of combustion during which the heating apparatus has been combusted since a press of the second switch, and the second memory unit stores the cumulative total time period of combustion continually updated.

In this application, the control unit compares the cumulative total time period of combustion detected by the monitor unit and stored in the second memory unit with the first reference value stored in the first memory unit, and outputs the control signal when the cumulative total time period of combustion becomes equal to or greater than the first reference value.

The display unit of the system receives the first control signal output from the control unit to display the cumulative total time period of combustion stored in the second memory unit. The display unit also receives the second control signal output from the control unit to display the cumulative total time period of combustion stored in the second memory unit and the message for informing the operator of a timing of maintenance.

In another preferable application, the monitor unit detects a combustion frequency representing a number of times combustion has taken place in the heating apparatus since a press of the second switch, and the second memory unit stores the combustion frequency continually updated.

In this application, the control unit compares the combustion frequency detected by the monitor unit and stored in the second memory unit with the first reference value stored in the first memory unit, and outputs the control signal when the combustion frequency becomes equal to or greater than the first reference value.

The display unit of the system receives the first control signal output from the control unit to display the combustion frequency stored in the second memory unit. The display unit also receives the second control signal output from the control unit to display the combustion frequency stored in the second memory unit and the message for informing the operator of a timing of maintenance.

As another application of the invention, the monitor unit may detect both the cumulative total time period of combustion and the combustion frequency. In this structure, the first memory unit stores a first reference information value and a second reference information value, and the second memory unit stores both the cumulative total time period of combustion and the combustion frequency. The control unit compares the cumulative total time period of combustion and the combustion frequency respectively with the first reference information value and the second reference information value, and outputs a second control signal when the cumulative total time period of combustion becomes equal to or greater than the first reference information value or when the combustion frequency becomes equal to or greater than the second reference information value.

The monitor system of the invention incorporated in the heating apparatus continuously monitors the predetermined operating condition, such as the combustion frequency and the cumulative total time period of combustion, and updates the predetermined operating condition stored in the second memory unit. When the predetermined operating condition becomes equal to or greater than the first reference value stored in the first memory unit, the control unit outputs the second control signal to actuate the display unit to display the message informing the operator of a timing of maintenance. This allows the operator to perform maintenance without delay and effectively prevents troubles or abnormalities from being developed in the heating apparatus.

These and other objects, features, aspects, and advantages of the present invention will become more apparent from the following detailed description of the preferred embodiment with the accompanying drawings.

DESCRIPTION OF THE PREFERRED EMBODIMENT

Figure 1:
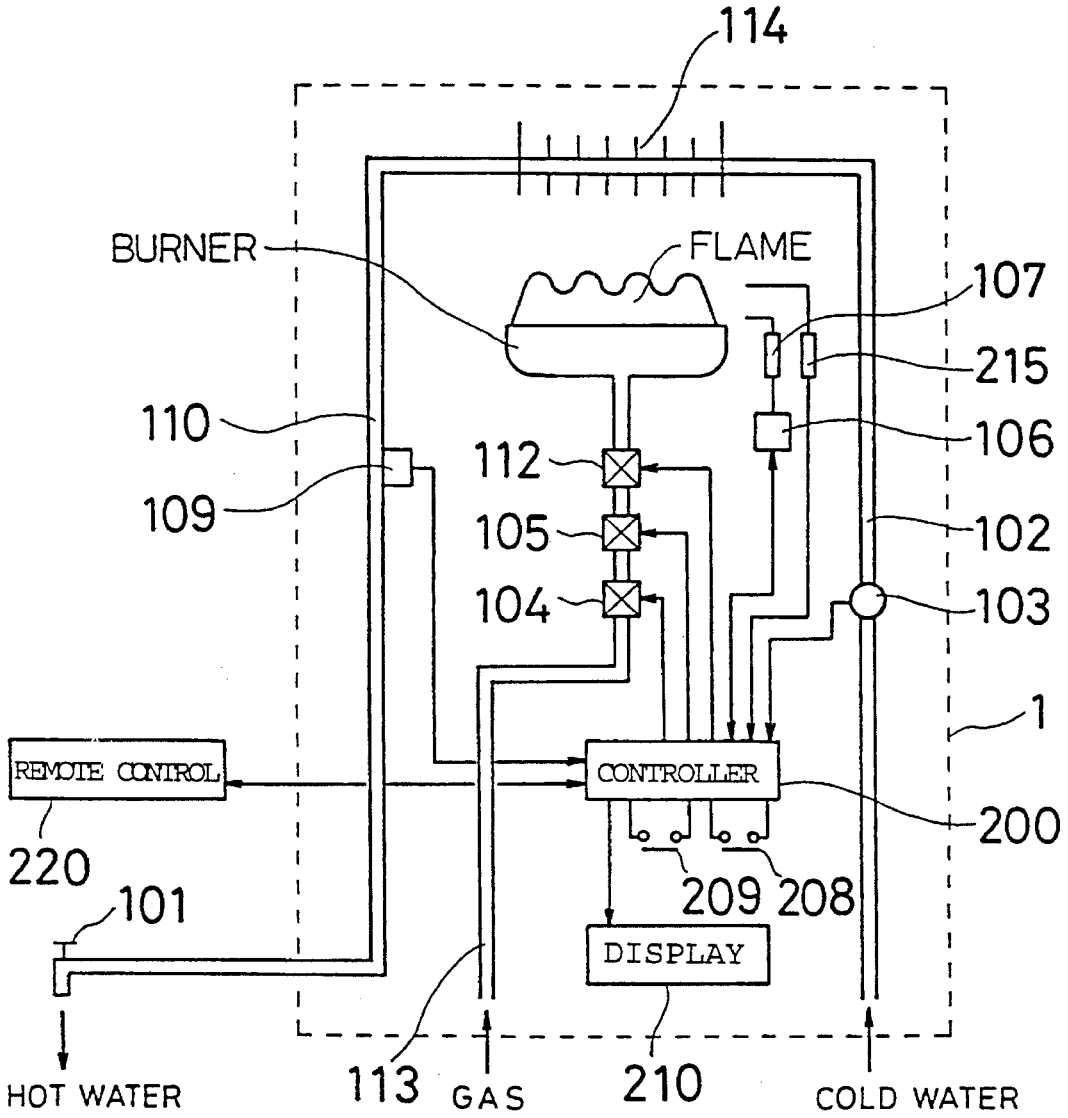
FIG. 1 schematically shows an essential structure of a monitor system incorporated in a hot water heater, as an embodiment according to the invention.

FIG. 1 schematically shows an essential structure of a monitor system incorporated in a hot water heater 1, as an embodiment according to the invention.

When a user opens a faucet 101, cold water starts running through a cold water supply pipe 102 to turn a water flow switch 103 on. The turn-on operation of the water flow switch 103 opens both a main solenoid valve 104 and a primary solenoid valve 105 for receiving gas through a gas conduit 113 and activates an igniter 106 leading to discharge from an ignition electrode 107 for ignition. A controller 200 then compares a temperature detected by a water temperature sensor 109 attached to a hot water supply pipe 110 with a fixed temperature previously set in a remote control 220, and adjusts an opening of a proportional solenoid valve 112 based on the difference between the temperature measured and the fixed temperature. The opening of the proportional solenoid valve 112 here represents an amount of combustion. Through this feed-back control for adjusting the amount of combustion according to the deviation of the temperature, the temperature of hot water running from the faucet 101 is set approximately equal to the fixed temperature. When the user closes the faucet 101, the water flow switch 103 is turned off to close the main solenoid valve 104 and the primary solenoid valve 105 to stop supplying hot water.

The hot water heater 1 is further provided with a heat exchanger 114, a flame rod detector 215 for detecting flame, a fan (not shown) for supplying the air to a burner, and a bimetal thermostat (not shown) for detecting excessive heat or overheat.

Figure 2:
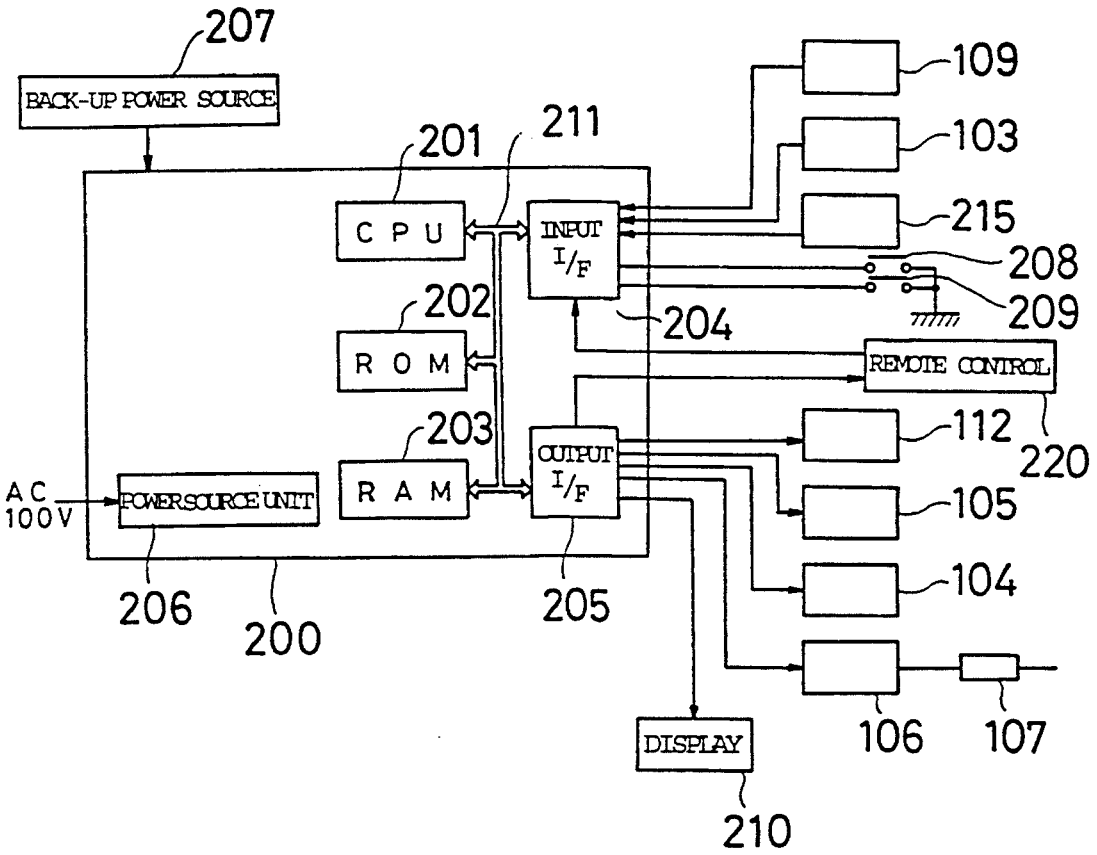
FIG. 2 is a block diagram showing an electric structure of a controller in the embodiment.

As clearly shown in the block diagram of FIG. 2, the controller 200 of the embodiment monitors and controls operating conditions of the hot water heater 1 as well as executes combustion control in the hot water heater 1 as described above. The controller 200 includes a CPU (central processing unit) 201 for executing a variety of programs for controlling combustion and monitoring and controlling predetermined operating conditions of the hot water heater 1, a ROM (read only memory) 202 for storing the variety of programs used for combustion control and monitor and control of the operating conditions, a RAM (random access memory) 203 for temporarily storing the predetermined operating conditions and other data required for control and monitor, an input interface 204, and an output interface 205, which are connected to one another via a bus 211. The predetermined operating conditions stored in the RAM 203 include a combustion frequency nx and a cumulative total time period of combustion tx as described later. The controller 200 is also provided with a power source unit 206 and a back-up power source 207 used for maintaining contents in the RAM 203 during non-supply of electricity from the power source unit 206.

The controller 200 is connected to the water temperature sensor 109, the water flow switch 103, and the flame rod detector 215 via the input interface 204 to receive input signals from these elements. The controller 200 is also connected to the proportional solenoid valve 112, the primary solenoid valve 105, and the main solenoid valve 104 via the output interface 205 to output control signals to these elements for opening and closing these solenoid valves 104, 105, and 112 and determining the opening of the proportional solenoid valve 112. The output interface 205 of the controller 200 is further connected to the ignition electrode 107 via the igniter 106 to trigger the igniter 106 and activate the ignition electrode 107 in response to the opening of the faucet 101.

The remote control 220 is connected with the input interface 204 and the output interface 205 of the controller 200 to output and input various data. A display requirement switch 208 and a maintenance completion switch 209 are electrically coupled with the controller 200 via the input interface 204 whereas a display 210 is connected to the controller 200 via the output interface 205. The display 210 shows the predetermined operating conditions, for example, the combustion frequency nx and the cumulative total time period of combustion tx, and a message informing the user of a timing of maintenance as described later in detail.

Figure 3:
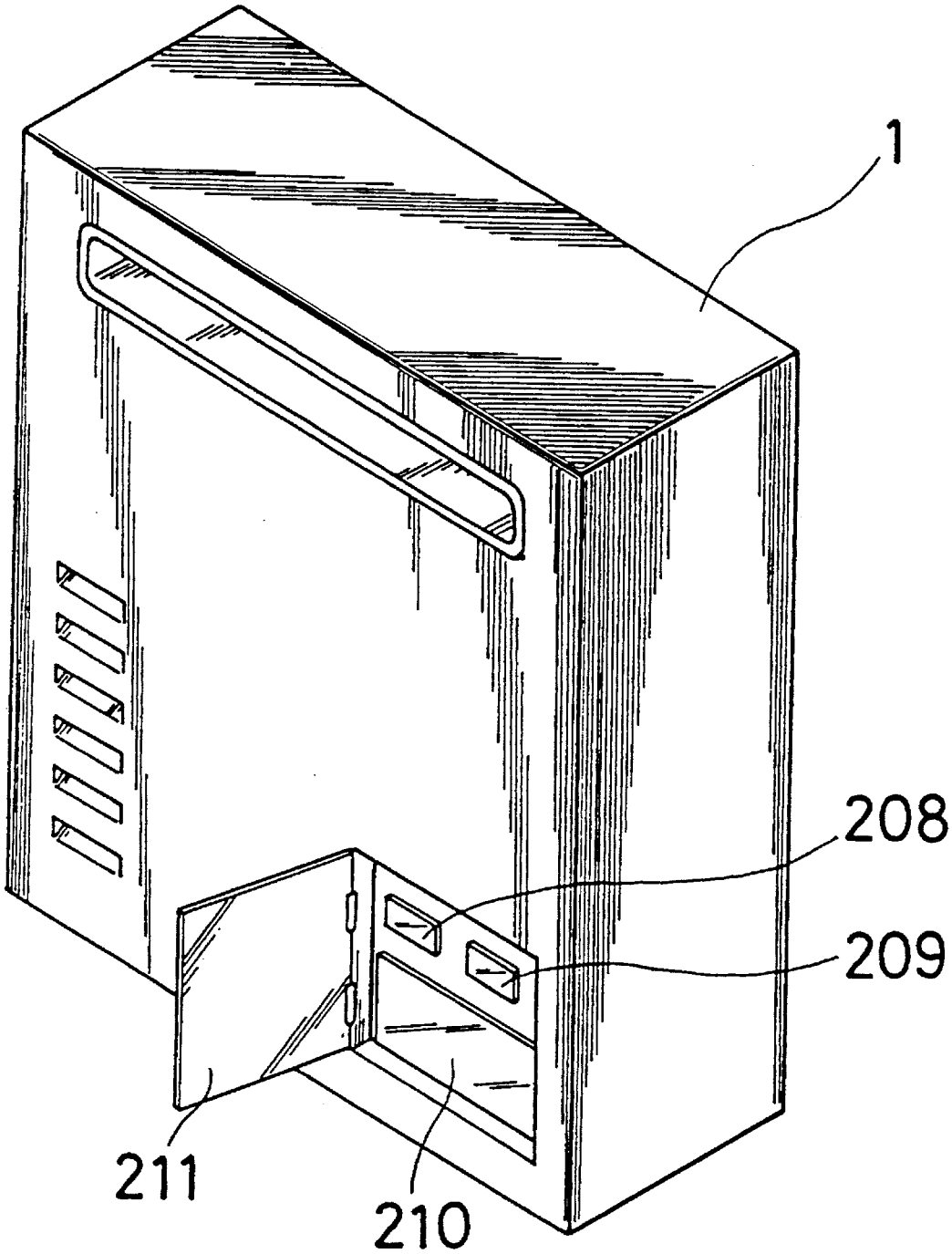
FIG. 3 is a perspective view illustrating a hot water heater having a monitor system of the embodiment therein.

The display requirement switch 208, the maintenance completion switch 209, and the display 210 may be placed on a front panel of the hot water heater 1 and covered with a door 211 as shown in FIG. 3.

When the user presses the display requirement switch 208, the predetermined operating conditions, the combustion frequency nx and the cumulative total time period of combustion tx, stored in the RAM 203 are output to the display 210 via the output interface 205 to be shown on a monitor screen of the display 210. The user presses the maintenance completion switch 209 every time when the user completes the maintenance procedures required.

In this embodiment, the RAM 203 stores the combustion frequency nx representing a number of times combustion has taken place in the hot water heater 1 since a press of the maintenance completion switch 209, and the cumulative total time period of combustion tx during which the hot water heater 1 has been combusted since a press of the maintenance completion switch 209. Both the combustion frequency nx and the cumulative total time period of combustion tx are continually updated in the RAM 203 in response to combustion of the hot water heater 1.

The combustion frequency nx and the cumulative total time period of combustion tx are determined by counting a number of ON/OFF times of the flame rod detector 215 and measuring a total running time of the flame rod detector 215, respectively.

The flame rod detector 215 can also detect specific abnormalities including ignition failure and incomplete combustion.

Figure 5A:
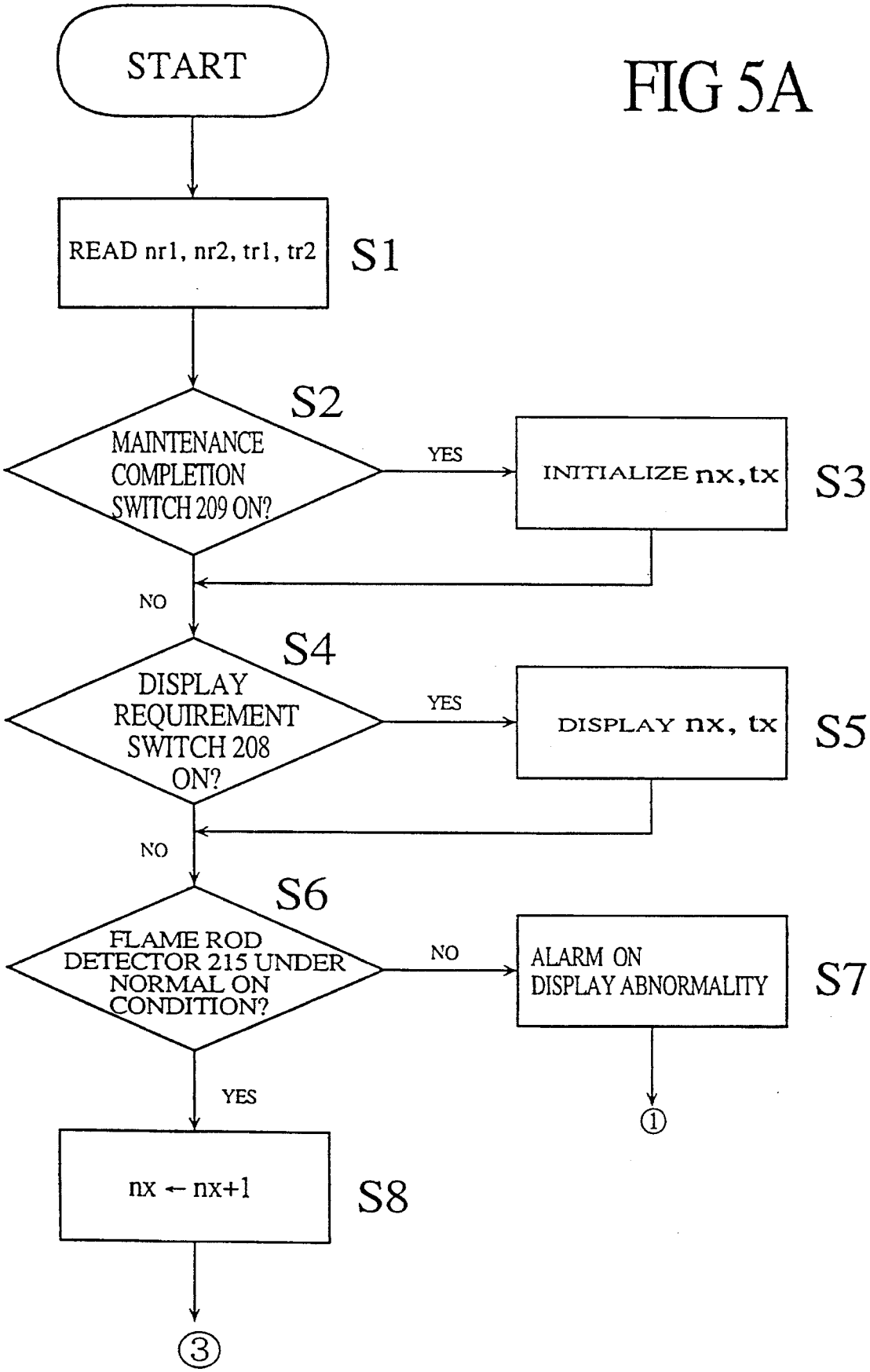
FIGS. 5A and 5B are flowcharts showing a routine of monitoring a combustion frequency nx and a cumulative total time period of combustion tx and informing the user of a timing of maintenance.
Figure 5B:
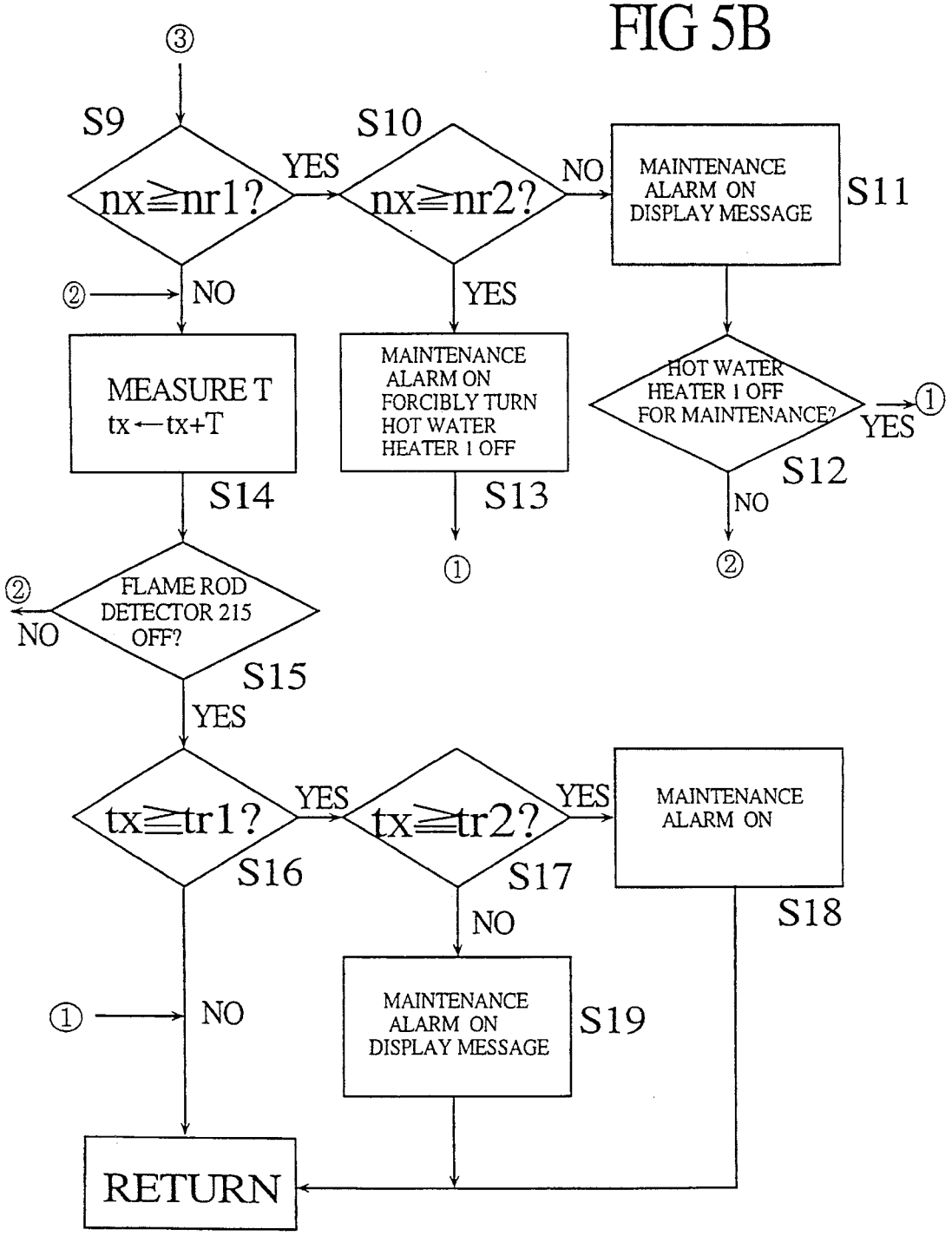
Figure 6:
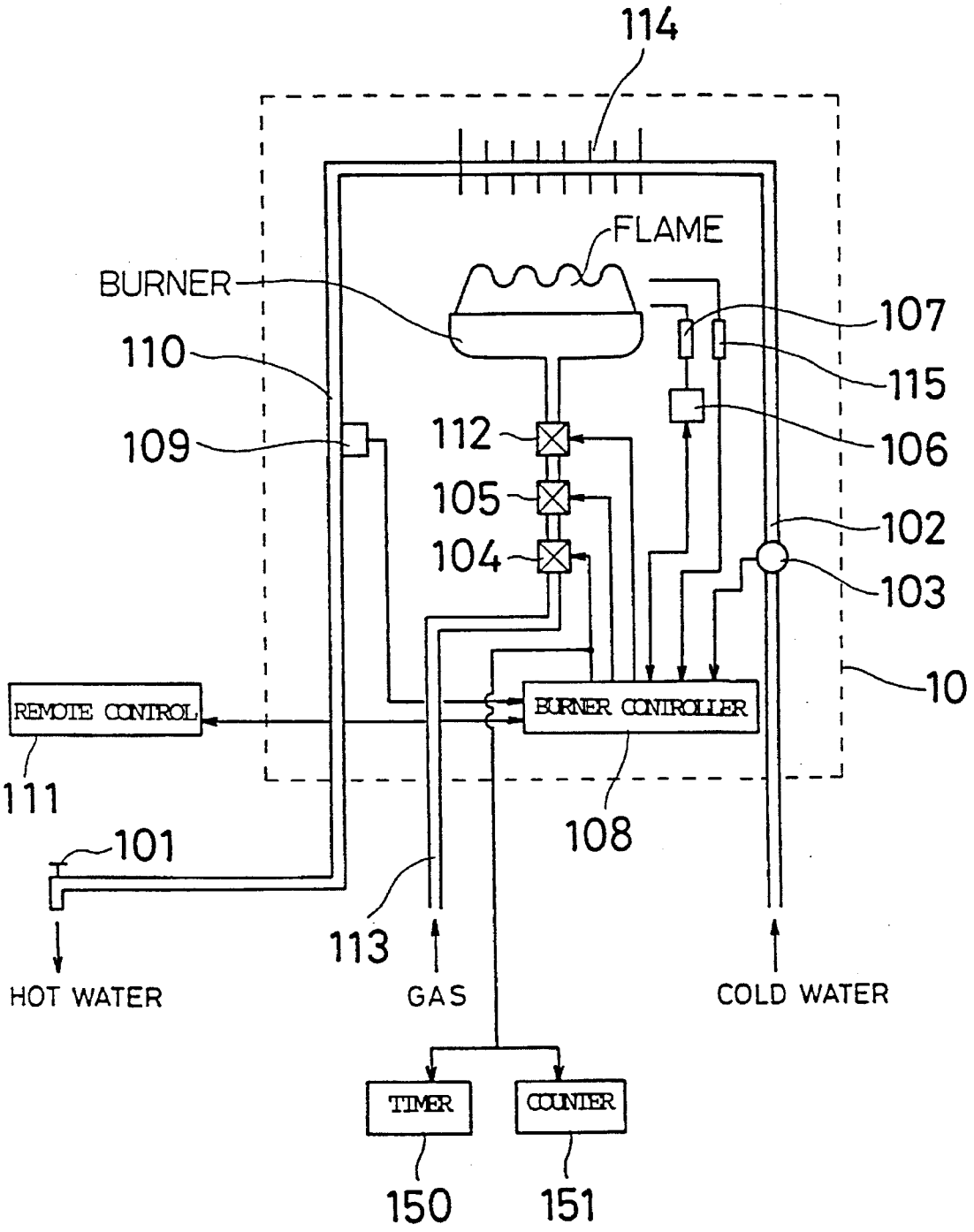
FIG. 6 schematically shows a typical structure of a conventional monitor system incorporated in a hot water heater.

FIGS. 5A and 5B are flowcharts showing a routine of monitoring the combustion frequency nx and the cumulative total time period of combustion tx and informing the user of a timing of maintenance. This routine is stored in the ROM 202 and executed by the CPU 201 of the controller 200.

When the user opens the faucet 101 of the hot water heater 1, the program enters the routine and first goes to step S1 at which the CPU 201 reads a first reference value nr1 and a second reference value nr2 to be compared with the combustion frequency nx, and a third reference value tr1 and a fourth reference value tr2 to be compared with the cumulative total time period of combustion tx, which are previously set in the RAM 203 by the user. The second reference value nr2 is set greater than the first reference value nr1 whereas the fourth reference value tr2 is set greater than the third reference value tr1.

The CPU 201 then reads whether the maintenance completion switch 209 is pressed ON at step S2. When the maintenance completion switch 209 is ON at step S2, the program proceeds to step S3 at which the combustion frequency nx and the cumulative total time period of combustion tx stored in the RAM 203 are initialized to zero. When the maintenance completion switch 209 is OFF at step S2 or after initialization of the combustion frequency nx and the cumulative total time period of combustion tx at step S3, the program goes to step S4 at which the CPU 201 reads whether the display requirement switch 208 is pressed ON.

Figure 4A:
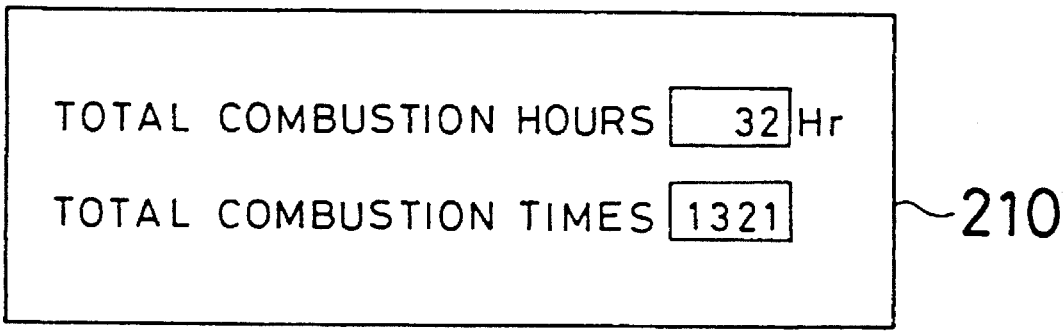
FIGS. 4A and 4B show examples of a display and a message shown on a monitor screen of the display.

When the display requirement switch 208 is ON at step S4, the program proceeds to step S5 at which the combustion frequency nx and the cumulative total time period of combustion tx stored in the RAM 203 are read out and shown on the display 210. FIG. 4A shows an example where the combustion frequency nx and the cumulative total time period of combustion tx are respectively shown as 'total combustion times' and 'total combustion hours' on the display 210.

When the display requirement switch 208 is OFF at step S4 or after display of the combustion frequency nx and the cumulative total time period of combustion tx at step S5, the program goes to step S6 at which it is determined whether the flame rod detector 215 is under a normal ON condition.

When the flame rod detector 215 is not under the normal ON condition but under an abnormal OFF condition, the program goes to step S7 at which the flame rod detector 215 outputs a first abnormal signal or a second abnormal signal to the controller 200. The controller 200 then outputs the first abnormal signal or the second abnormal signal to the display 210 and an alarm (not shown) mounted on the hot water heater 1 according to the reason of the OFF condition. The first abnormal signal is output to inform an ignition failure whereas the second abnormal signal represents an incomplete combustion. According to the first or second abnormal signal, the alarm informs the user of abnormal combustion while a message representing either the ignition failure or the incomplete combustion is shown on the display 210. After the user, in response to the message and the alarm, turns the faucet 101 off to close the primary solenoid valve 105 and the main solenoid valve 104, the program goes to RETURN to exit from the routine.

When the flame rod detector 215 is under the normal ON condition at step S6, on the other hand, the program goes to step S8 at which the combustion frequency nx is incremented by one. At step S9, the CPU 201 compares the combustion frequency nx with the first reference value nr1. When the combustion frequency nx is equal to or greater than the first reference value nr1 at step S9, the program goes to step S10 at which the combustion frequency nx is then compared with the second reference value nr2.

When the combustion frequency nx is not less than the second reference value nr2 at step S10, the program goes to step S13 at which the controller 200 outputs a maintenance alarm signal to the maintenance alarm and the display 210 and forcibly turns the hot water heater 1 off for maintenance. The program then goes to RETURN to exit from the routine. The user presses the maintenance completion switch 209 after completion of the maintenance procedures required.

When the combustion frequency nx is less than the second reference value nr2 at step S10, on the other hand, the program goes to step S11 at which the controller 200 outputs a first maintenance requirement signal to a maintenance alarm (not shown) mounted on the hot water heater 1 and the display 210. According to the first maintenance requirement signal, the maintenance alarm sounds to inform the user of a timing of maintenance while a message telling the user to implement maintenance procedures is shown on the display 210. The combustion frequency nx and the cumulative total time period of combustion tx may also be shown on the display 210. The program then goes to step S12 at which it is determined whether the hot water heater 1 is turned off for maintenance.

When the user turns the hot water heater 1 off to conduct the maintenance in response to the maintenance alarm and the message, the program goes to RETURN to exit from the routine. The user presses the maintenance completion switch 209 after completion of the maintenance procedures required.

When the user does not turn the hot water heater 1 off for maintenance at step S12 or when the combustion frequency nx is less than the first reference value nr1, the program goes to S14 at which the controller 200 measures a time period T during which the flame rod detector 215 is under the normal ON condition and adds the time period T to the cumulative total time period of combustion tx, until the flame rod detector 215 detects an OFF condition at step S15. When the hot water heater 1 is turned off and the flame rod detector 215 becomes OFF at step S15, the program goes to step S16 at which the cumulative total time period of combustion tx is compared with the third reference value tr1.

When the cumulative total time period of combustion tx is less than the third reference value tr1, the program goes to RETURN to exit from the routine.

When the cumulative total time period of combustion tx is not less than the third reference value tr1 at step S16, on the contrary, the program goes to step S17 at which the cumulative total time period of combustion tx is compared with the fourth reference value tr2.

When the cumulative total time period of combustion tx is not less than the fourth reference value tr2, the program goes to step S18 at which the controller 200 outputs the maintenance alarm signal to the maintenance alarm and the display 210. In this case, the hot water heater 1 can not be turned on after the user completes the maintenance procedures and presses the maintenance completion switch 209 ON. The program then goes to RETURN to exit from the routine.

Figure 4B:
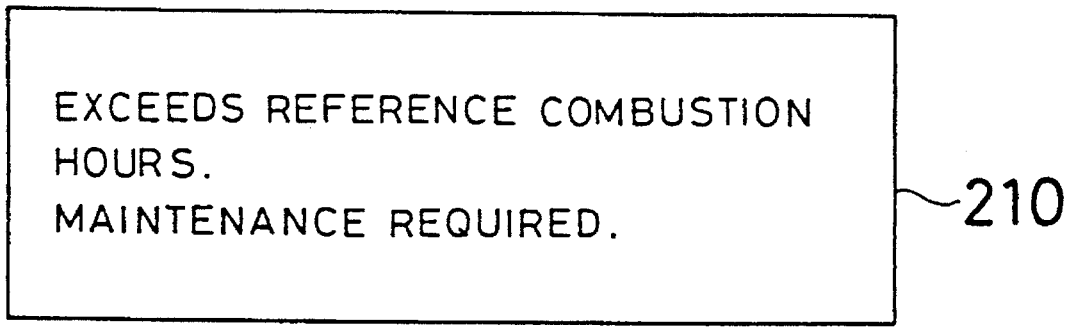

When the cumulative total time period of combustion tx is less than the fourth reference value tr2, the program goes to step S19 at which the controller 200 outputs a second maintenance requirement signal to the maintenance alarm and the display 210. According to the second maintenance requirement signal, the maintenance alarm sounds to inform the user of a timing of maintenance while a message telling the user to implement maintenance procedures is shown on the display 210. The combustion frequency nx and the cumulative total time period of combustion tx may also be shown on the display 210. FIG. 4B shows an exemplified message shown on the display 210. In this case, the hot water heater 1 can be turned on even when no maintenance is executed. The program then goes to RETURN to exit from the routine.

The display 210, for example, having a dot matrix LCD as a monitor screen, may be mounted on the remote control 220 instead of the front panel of the hot water heater 1.

As described above, in the hot water heater 1 of the embodiment, the display and the maintenance alarm inform the user of a timing of maintenance when the combustion frequency nx becomes equal to or greater than the first reference value nr1 or when the cumulative total time period of combustion tx becomes equal to or greater than the second reference value tr1. This allows the user to perform maintenance without delay and prevents troubles or abnormalities from being developed in the hot water heater 1.

There may be many other alterations, changes, and modifications without departing from the scope or spirit of essential characteristics of the invention. It is thus clearly understood that the above embodiment is only illustrative and not restrictive in any sense. The spirit and scope of the present invention is limited only by the terms of the appended claims.

What is claimed is:

1. A water heater combustion system, said system including first means for receiving and discharging water and combustion means operatively integrated with said first means for operating to heat water in said first means by combustion, said system further comprising sensor means for detecting a condition of operation and producing an indication thereof memory means for storing and accumulating indications of the condition of operation by said sensor means alarm state detection means for determining when the accumulated indications of the condition of operation in said memory means exceed a first threshold value alarm means responsive to said alarm state detection means for providing a warning display indicative of a determination that said first threshold value is exceeded, and operation stop means for forcibly stopping operation of said water heater when said accumulated indications of said condition of operation exceed a second threshold value.

2. A combustion system in accordance with claim 1, wherein the accumulated indications of the condition of operation represent frequency of combustion.

3. A combustion system in accordance with claim 1, wherein the accumulated indications of the condition of operation represent cumulative total time of combustion.

4. A system in accordance with claim 1, said system further comprising resetting means for resetting said memory means to initialize said accumulated indications of the operating condition stored in said memory means.

5. A system in accordance with claim 4, wherein said alarm state detection means include a monitor which detects a cumulative total time period of combustion during which said combustion means has been combusted since resetting said resetting means, and said memory means stores said cumulative total time period of combustion continually updated.

6. A system in accordance with claim 5, wherein said alarm state detection means compares said cumulative total item period of combustion detected by said monitor means and stored in said memory means with said first threshold value stored in said memory means, and outputs a second control signal when said cumulative total time period of combustion becomes equal to or greater than said first threshold value, said alarm means receiving said control signal to display said cumulative total time period of combustion stored in said memory means, and receiving said second control signal to display said cumulative total time period of combustion in said memory means and a message to inform an operator to schedule maintenance.

7. A system in accordance with claim 4, wherein said alarm state detection means detects a combustion frequency representing a number of times combustion has taken place in said heating apparatus since resetting said resetting means, and said memory means stores said combustion frequency continually updated.

8. A system in accordance with claim 7, wherein said alarm state detection means compares said combustion frequency stored in said memory means with the said first threshold value stored in said memory means, and outputs a second control signal when said combustion frequency becomes equal to or greater than said first threshold value, said alarm means receiving said control signal to display said combustion frequency stored in said memory means, and receiving said second control signal to display said combustion frequency stored in said memory means and a message for informing the operator to schedule maintenance.

9. A system for monitoring operation of a water heating apparatus to inform an operator to schedule maintenance, said apparatus being of the type having a burner for heating water by combustion and said system comprising monitor means for continuously detecting both a cumulative total time period of combustion during which said water heating apparatus has been combusted and a combustion frequency representing a number of times combustion has taken place in said water heating apparatus, first memory means for storing a first reference information value and a second reference information value, second memory means for storing and continually updating said cumulative total time period of combustion and said combustion frequency continuously detected by said monitor means, first switch means for outputting a display signal requiring display of said cumulative total time period of combustion and said combustion frequency, control means for receiving said display signal output from said first switch means and outputting a first control signal in response to said display signal, said control means comparing said cumulative total time period of combustion stored in said second memory means with said first reference information value stored in said first memory means, and further comparing said combustion frequency stored in said second memory means with said second reference information value stored in said first memory means, and said control means outputting a second control signal when said cumulative total time period of combustion becomes equal to or greater than said first reference information value or when said combustion frequency becomes equal to or greater than said second reference information value, and display means responsive to receiving said first control signal output from said control means for displaying said cumulative total time period of combustion and said combustion frequency stored in said second memory means, and responsive to receiving said second control signal output from said control means for displaying a message for informing the operator to schedule maintenance said system further comprising forcible operation-stop means for forcibly stopping operation of said heating apparatus when one of said cumulative totals is greater than a third reference information value.

10. A system in accordance with claim 8, said system further comprising second switch means for resetting said second memory means to initialize said cumulative total time period of combustion and said combustion frequency stored and continually updated in said second memory means.

* * * * *